US005823390A

United States Patent [19]

Muderlak et al.

[11] Patent Number: 5,823,390

[45] Date of Patent: Oct. 20, 1998

[54] CHEMICAL DISPENSING APPARATUS HAVING A PIVOTAL ACTUATOR

[75] Inventors: Kenneth J. Muderlak, Shorewood, Wis.; Rocky Sheih, Hsin Chu, Taiwan

[73] Assignee: Technical Concepts, L.P., Mundelein, Ill.

[21] Appl. No.: 540,235

[22] Filed: Oct. 6, 1995

[51] Int. Cl.[6] ..... B67D 5/22

[52] U.S. Cl. ..... 222/38; 222/39; 222/63; 222/333; 222/642; 222/644

[58] Field of Search ..... 222/38, 39, 63, 222/183, 333, 642, 643, 644

[56] References Cited

U.S. PATENT DOCUMENTS

| | | | |
|---|---|---|---|
| 2,821,435 | 1/1958 | Wenner | 299/82.5 |
| 3,286,883 | 11/1966 | Takiff | 222/173 |
| 4,185,224 | 1/1980 | Thompson | 222/39 X |
| 4,286,590 | 9/1981 | Murase | 128/214 E |
| 4,454,966 | 6/1984 | Hicks | 222/153 |
| 4,483,466 | 11/1984 | Gutierrez | 222/647 |
| 4,615,476 | 10/1986 | Hobbs et al. | 222/153 |
| 4,667,856 | 5/1987 | Nelson | 222/180 |
| 4,953,763 | 9/1990 | Kierum et al. | 222/644 |
| 4,967,935 | 11/1990 | Celest | 222/63 |
| 5,027,982 | 7/1991 | Demerest | 222/182 |
| 5,055,822 | 10/1991 | Campbell et al. | 222/644 X |
| 5,156,308 | 10/1992 | Aoyama | 222/145 |
| 5,234,132 | 8/1993 | Bachand et al. | 222/182 |
| 5,249,728 | 10/1993 | Muderlak | 222/642 |
| 5,255,827 | 10/1993 | Breault et al. | 222/309 |
| 5,271,526 | 12/1993 | Williams | 222/642 X |
| 5,348,193 | 9/1994 | Bruckner et al. | 222/175 |
| 5,429,270 | 7/1995 | Tumminia | 222/642 X |
| 5,558,639 | 9/1996 | Gangemi et al. | 222/63 X |

*Primary Examiner*—Joseph Kaufman
*Attorney, Agent, or Firm*—Sonnenshein Nath & Rosenthal

[57] ABSTRACT

The invention includes an actuator system for a chemical dispensing apparatus where the chemical dispensing apparatus includes a chemical-containing vessel and a housing. The invention also includes an actuator nozzle having a receiving aperture and a dispensing aperture where the receiving aperture is operatively coupled to the vessel to receive the chemicals contained within the vessel. The dispensing aperture is coupled to the receiving aperture and is also connected to a conveying tube to direct the chemical from the vessel, through the tube and into a chemical receiving receptacle. Also included is a structure for ejecting the chemical from the vessel into the actuator nozzle. The actuator nozzle is slidingly and pivotally mounted in the housing and is configured to slide vertically relative to the housing and is also configured to pivot outwardly relative to the housing to permit reciprocal engagement and disengagement of the vessel while maintaining communication with the conveying tube. The actuator nozzle remains in an upward and outwardly pivoted position when the vessel is disengaged from the actuator nozzle to facilitate reengagement of the vessel with the actuator nozzle.

37 Claims, 7 Drawing Sheets

CHEMICAL DISPENSING APPARATUS HAVING A PIVOTAL ACTUATOR

BACKGROUND OF THE INVENTION

The present invention relates generally to devices for controllably dispensing liquids, and more specifically to drip-type odorizing and disinfectant liquid dispensers having a pivotal actuator and an electronic detector and signal system.

Deodorizing and disinfecting treatment systems for urinals and toilet bowls are known in the art and are typically wall mounted units having wick-type dispensing systems that periodically allow drops of olfactory and biocidal fluid to flow through a tube and onto the surface to be treated, such as onto the inside of the toilet bowl or the inside wall of a urinal. The wicks are generally mounted to absorb fluid from a gravity-fed liquid reservoir, while another end of the wick is positioned to drip into a flow tube or other liquid guiding mechanism. At least a portion of the wick is exposed to facilitate odorizing of the surrounding area within a room. Hence, the wick serves as the liquid transfer mechanism between the reservoir, the flow tube and the odorizing medium.

Several problems exist with conventional wick-type systems since they typically require a number of time consuming and messy steps for installation and servicing. Generally, for installation or servicing, a wick must be inserted in a support tube and subsequently splayed at both of its ends so that the wick properly absorbs the liquid. Furthermore, the wick must typically be adjusted so that a sufficient length reaches either the liquid reservoir or the conveying tube to enable the drops to properly flow at a predetermined adjustable rate. The rate is generally adjusted by the size and type of wick used.

There are numerous types of olfactory and disinfectant liquids which typically have differing viscosities. A wick-type system will normally require a different wick for different viscosities of liquid given that the absorption and flow rates will differ depending upon the viscosity of the liquid. This generally requires the service personnel or user to stock a plurality of different wicks. If a user decides to use the same wick, the user is often restricted to using liquids having the same viscosity. Also, the wicks transfer (absorb) the liquid molecules with the lowest specific gravity first, such as alcohol or fragrance molecules. Therefore, the fragrance decreases rapidly after only several drops. Another problem occurs with conventional wick-type systems because the reservoir and wicks are typically exposed to the air. This allows dirt and air-borne particles to accumulate in the reservoir and on the wick. Consequently, clogging occurs because the wick transfers dirt particles to the flow tube opening. Clogging also occurs due to surfactants.

Other types of deodorizing and disinfecting systems are known which operate based on the flush action of the urinal or toilet and are often in-line devices. One such device is disclosed in U.S. Pat. No. 4,984,306 and is a system for injecting metered amounts of chemicals into flush water as the flush water enters the toilet. A small bore in an injector assembly connects to a chemical reservoir so that the chemical is directed into the flush water as the flush water passes through the assembly. Such in-line devices are typically costly and require time consuming installation. Other systems include devices having multiple discharge tubes to service more than one urinal or toilet. However, these units are costly and complex and require time consuming installation procedures.

Known deodorizing and disinfecting systems typically include a container of liquid chemical that must be periodically replenished at predetermined intervals. Replacement of the container is often time consuming and residue producing, as it may require disconnection of supply tubes and the container and subsequent reattachment of the container within the unit. Such systems do not provide a quick and easy method for replacing the chemical liquid container at periodic intervals.

Accordingly, it is a object of the present invention to substantially overcome the above-described problems.

It is another object of the present invention to provide a novel actuator nozzle to facilitate easy and rapid removal and installation of a chemical-containing vessel in a deodorizing and disinfecting system.

It is a further object of the present invention to provide a chemical dispensing apparatus that is simple and inexpensive to manufacture.

SUMMARY OF THE INVENTION

The disadvantages of known chemical delivery apparatus are substantially overcome with the present invention by providing a novel pivotal actuator system for a chemical delivery apparatus.

The present invention provides a novel pivotal actuator nozzle that may be rotated outwardly to facilitate quick and easy replacement of the chemical-containing container. When the container requires replacement, it is simply rotated a few degrees outwardly with the nozzle outwardly rotating along with rotation of the container. The container is then removed while the nozzle remains in the outwardly rotated position to facilitate rapid attachment of the replacement container. Once the replacement container has been connected to the nozzle, the container is downwardly rotated a few degrees as the nozzle pivots therewith until the bottle is in its original position.

More specifically, the present invention includes an actuator system for a chemical dispensing apparatus where the chemical dispensing apparatus includes a chemical-containing vessel and a housing. The invention includes an actuator nozzle having a receiving aperture and a dispensing aperture, where the receiving aperture is operatively coupled to the vessel to receive the chemicals contained within the vessel. The dispensing aperture is coupled to the receiving aperture and is also connected to a conveying tube to direct the chemical from the vessel, through the conveying tube and into a chemical receiving receptacle. Also included is a means for ejecting the chemical from the vessel into the actuator nozzle. The vessel in the preferred embodiment is a canister or bottle equipped with a pump to dispense fluid from the vessel. The present invention can also be used with aerosol dispensing vessels, as well as with equivalent fluid containing devices.

The actuator nozzle is slidingly and pivotally mounted in the housing, and is configured to slide vertically relative to the housing and to pivot outwardly to permit reciprocal engagement and disengagement of an actuating mechanism of the vessel while maintaining communication with the fluid conveying tube. The actuator nozzle remains in an upward and outwardly pivoted position when the vessel is disengaged from the actuator nozzle to facilitate reengagement of a replacement vessel with the actuator nozzle.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Although the below description will be made with reference to liquids for odorizing and disinfecting urinals, toilets and the like, it will be understood that the inventive dispensing apparatus may be used for controllably dispensing any suitable chemical, such as chlorine or other liquids for pools or other applications.

Figure 1:
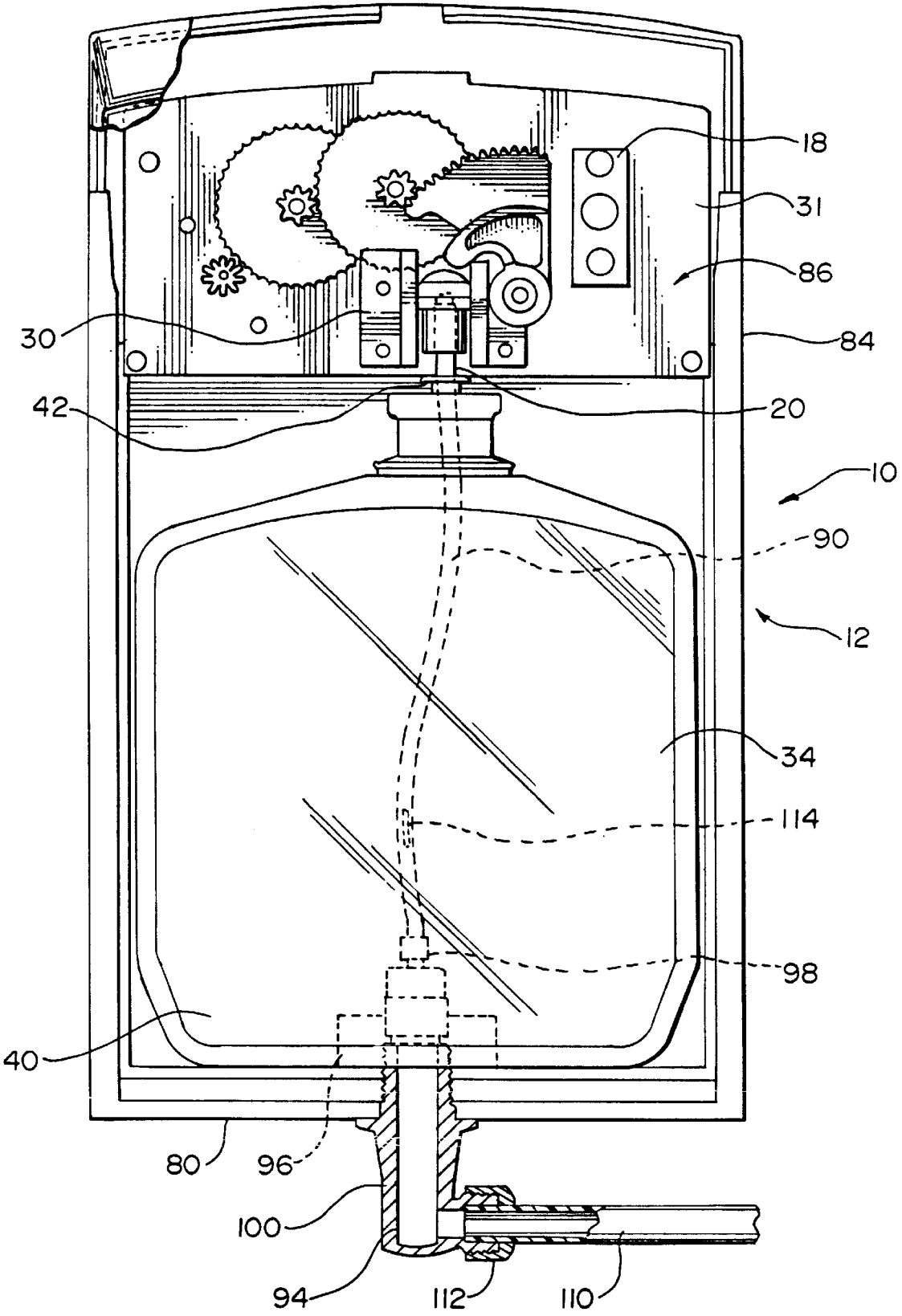
FIG. 1 is a front elevational sectional view of a specific embodiment of a chemical delivery apparatus having a pivotal actuator nozzle according to the prevent invention.
Figure 2:
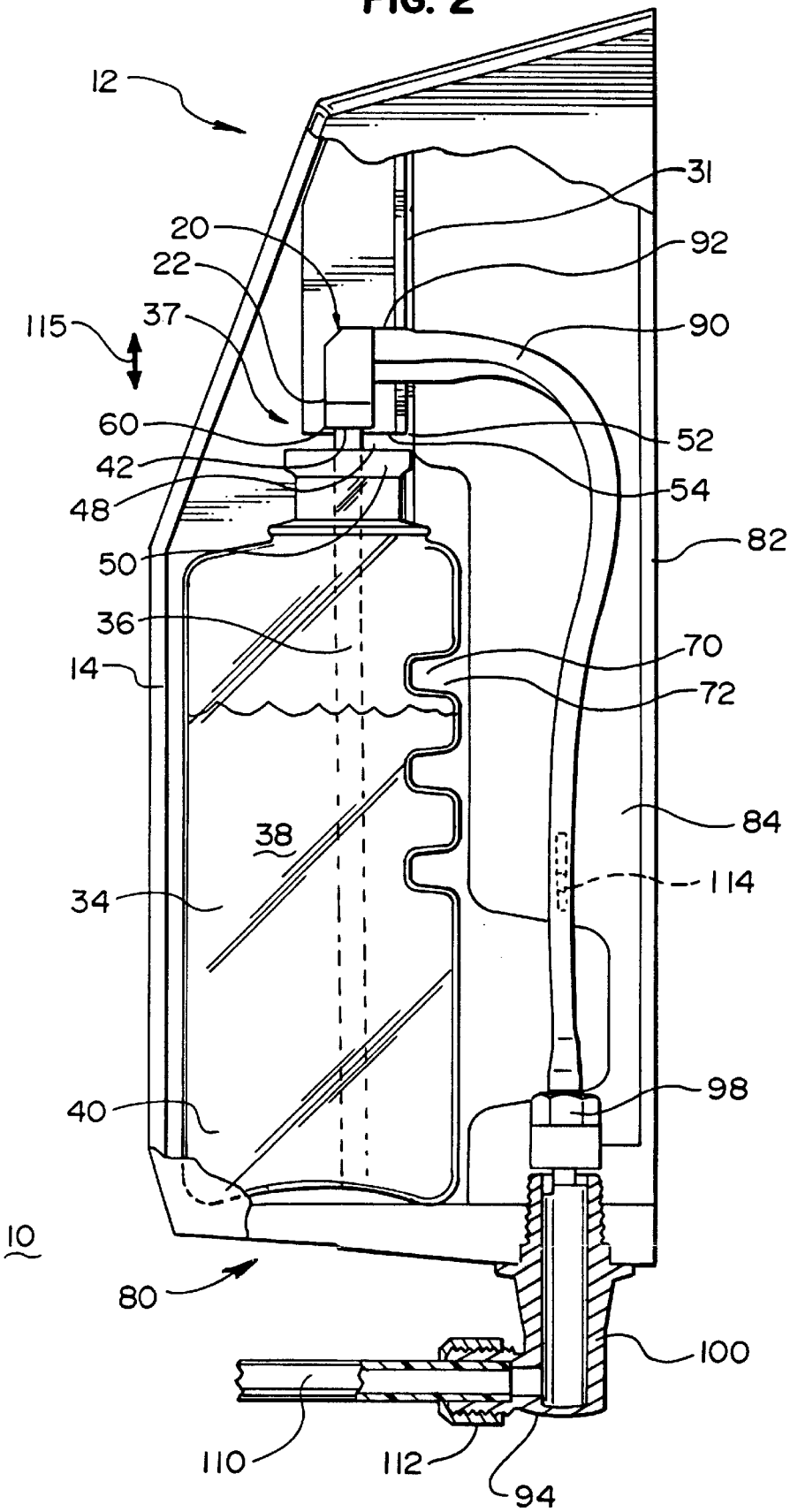
FIG. 2 is a side elevational sectional view of the chemical delivery apparatus having a pivotal actuator nozzle shown in FIG. 1.
Figure 3:
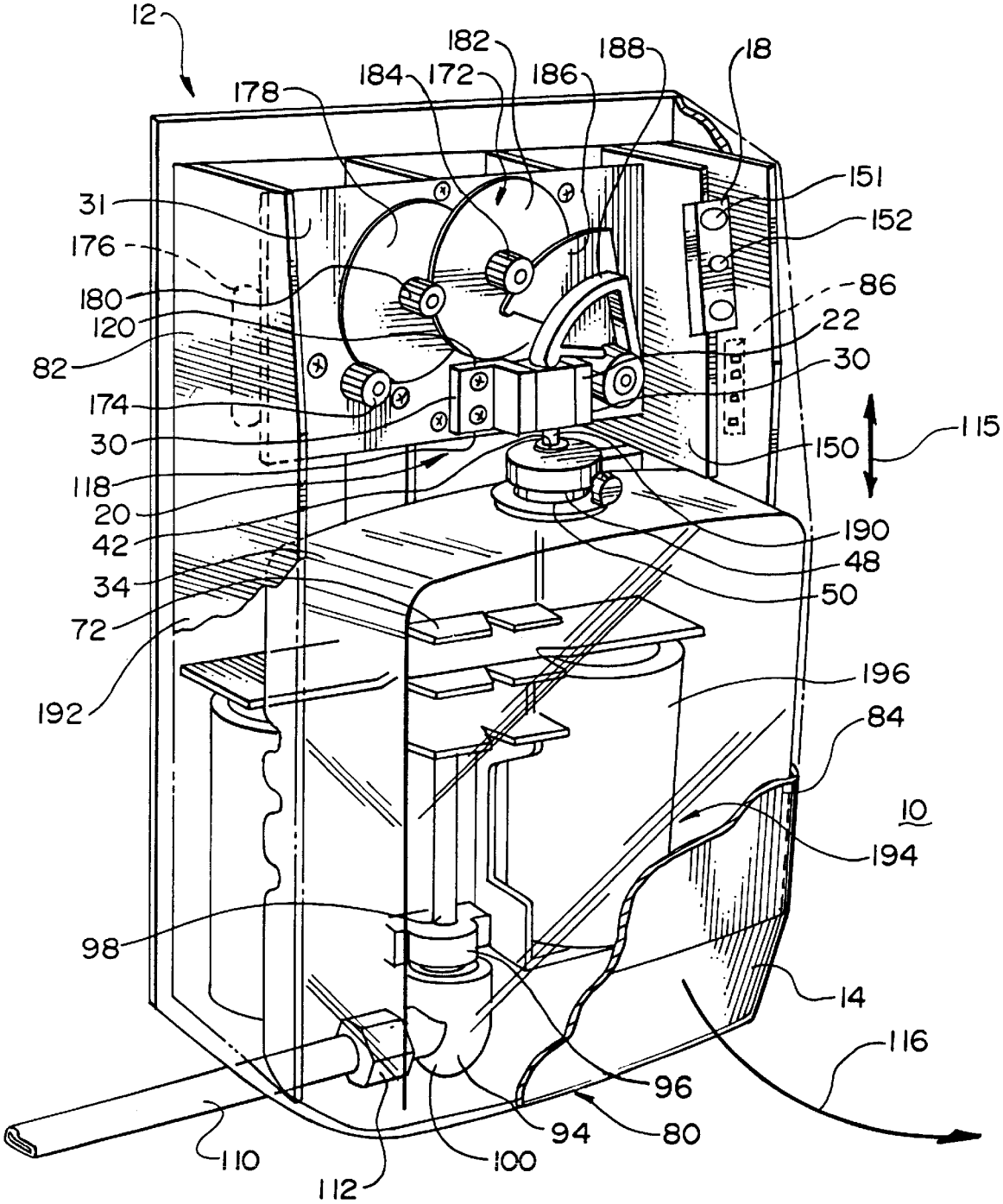
FIG. 3 is a perspective internal structural view of a specific embodiment of the apparatus shown in FIG. 1 in accordance with the invention having the front cover shown in outline form.

Referring now to FIGS. 1–3, a chemical delivery apparatus having a pivotal actuator is shown generally as 10. The apparatus includes a housing 12 and a hinged cover 14 (FIGS. 2–3). The housing 12 includes a viewing window 18 for visually observing the status of various aspects of the apparatus 10, as will be described hereinafter. The housing 12 and the cover 14 may be formed from high-impact plastic, metal or other suitable material, as is well known in the art.

A nozzle assembly 20 includes a pivotal actuator nozzle 22 which is mounted between a pair of oppositely disposed runners or guides 30 attached to a motor plate 31, as will be described hereinafter. A chemical-containing canister or bottle 34 is disposed in housing 12 and includes a hollow pump stem 36 attached to a pump mechanism 37 which directs an olfactory and/or disinfecting liquid 38 from a bottom portion 40 within the bottle to a receiving aperture 42 (FIG. 3) disposed within the nozzle 22. The nozzle 22 is disposed at the other end of the hollow pump stem 36. The receiving aperture 42 is operatively coupled to the bottle 34 through the pump stem 36 so that liquid 38 from the bottle is directed into the nozzle 22. The bottle 34 has a ferrule 48 disposed above a collar 50. The housing 12 includes a pair of integrally formed mounting grooves 52 and 54 which secure the collar 50 in place, thus securing the bottle 34 within the housing 12.

The bottle 34 includes a plurality of specifically oriented indentations 70 molded into the bottle which serve as a keying mechanism. The housing 12 has corresponding keys in the form of protrusions 72 which mate with the indentations 70 in the bottle 34 so that only properly keyed bottles may be inserted and correctly positioned into the housing.

The housing 12 includes a base portion 80 upon which the bottle 34 rests and a back wall 82 integrally formed with the base portion. The cover 14 includes side walls 84 forming a skirt such that when the cover engages the housing 12, a fully enclosed structure is formed which encloses the bottle 34 and other internal support and operating mechanisms. The cover 14 is hinged to the housing 12 along the base portion 80 so that the cover may be conveniently rotated away from the housing to allow removal and replacement of the bottle 34. A plurality of mode switches 86 or a switch array 15 is housed under the cover 14, the function of which will be described in greater detail hereinafter. The cover 14 may also be keyed to the housing 12 to prevent tampering and unauthorized access to the internal portion of the housing.

A conveying tube 90 is attached to a dispensing aperture 92 of the actuator nozzle 22. The dispensing aperture 92 operatively communicates with the receiving aperture 42 such that liquid 38 drawn from the bottle 34 into the receiving aperture is directed within the nozzle 22 to the dispensing aperture 92. The conveying tube 90 transports liquid 38 drawn from the bottle 34 by the pumping action of the actuator nozzle 22 into the conveying tube 90 and into an in-line connector 94.

The in-line connector 94 is secured to the back wall 82 of the housing 12 by a threaded retaining ring or clamp 96. The in-line connector 94 includes a nipple portion 98 to which the conveying tube 90 is coupled. The in-line connector 94 also includes a rotatable portion 100 which is capable of swiveling one-hundred and eighty degrees relative to the body of the in-line connector. This allows an in-line tube 110 to be attached to the in-line connector 94 for convenient and easy placement and routing of the in-line tube so that the liquid 38 within the bottle 34, when dispensed, is directed into a urinal, toilet or other suitable destination (not shown). A nut 112 or other pressure fitting may be used to secure the in-line tube 100 to the end of the in-line connector 94. Any suitable in-line connector 94 capable of fluid transport may be used. The conveying tube 90 includes a hose insert or restrictor insert 114 (FIGS. 1 and 2) which provides a number of advantages, as will be described in greater detail hereinafter.

Figure 4A:
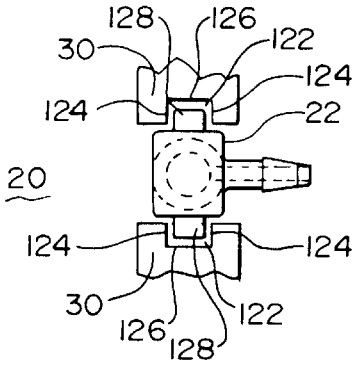
FIG. 4A is a top plan view of a specific embodiment of a pivotal actuator nozzle and a portion of the chemical delivery apparatus which guides movement of the nozzle.
Figure 4B:
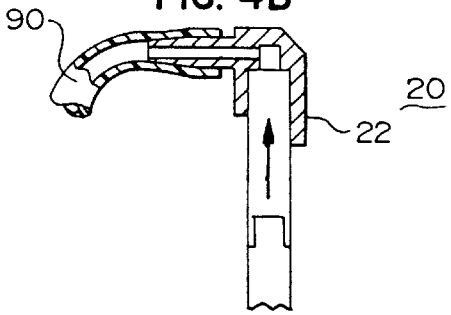
FIG. 4B is a side elevational sectional view of the pivotal actuator nozzle shown in FIG. 4A.

Referring now to FIGS. 3 and 4A–4F, the nozzle assembly 20 is shown generally in FIGS. 3 and 4A. The nozzle 22 is slidingly and pivotally mounted within the pair of guides 30 attached to the motor plate 31. This allows the nozzle 22 to slide or to be reciprocally displaced in a vertical direction relative to the housing, as shown by arrow 115 of FIGS. 2–3. The nozzle 22 is also capable of outward pivotal movement relative to the housing 12 to permit reciprocal engagement and disengagement of the bottle 34, as shown by arrow 116 of FIGS. 3 and 4E. As the nozzle 22 pivots, it maintains communication with the conveying tube 90 to prevent leakage of liquid 38. All connections between the bottle 34, the nozzle 22, the conveying tube 90 and the in-line connector 94 are liquid-tight to prevent inadvertent fluid spills or leaks.

The guides 30 each are formed as "L-shaped" brackets that project outwardly and away from the motor plate 31 to which they are mounted (FIG. 3). The guides 30 may be constructed from plastic, metal or any other suitable material. Each guide 30 includes a guide base 118 and a guide mount portion 120 outwardly projecting from the guide base at right angles. The guide base 118 is secured to the motor plate 31 by screws, rivets, bolts, welds or any other suitable method. Two guide mount portions 120 opposingly face each other so that the nozzle 22 may be mounted therebetween. Each guide mount portion 120 comprises a vertical groove or channel 122 disposed along its center, as best shown in FIG. 4A. The channel 122 may extend along the entire height of the guide mount portion 120, as shown in the illustrated embodiment, or may extend for only a portion of the height of the guide mount, thus providing a bounded channel. Each channel 122 has two vertical sidewalls 124 and a vertical base portion 126 to facilitate vertical displacement and guiding of the nozzle 22.

The nozzle 22 includes two tabs 128 outwardly projecting from opposite sides of the nozzle, which tabs are configured to communicate with the corresponding channels 122 disposed in the guide mount portions 120. When the nozzle 22 is placed between the opposing guides 30, the tabs 128 on each side of the nozzle form a releasable interference fit with the channels 122 sufficient to retain the nozzle in place while allowing simple hand pressure to vertically displace the nozzle.

Figure 4C:
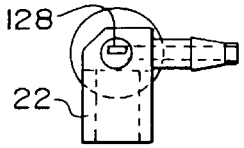
FIGS. 4C–4E are side elevational views of the pivotal actuator nozzle shown in FIG. 3A, particularly showing oblong shaped tabs.
Figure 4D:
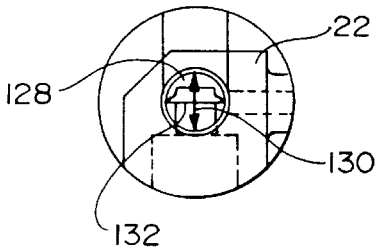
Figure 4E:
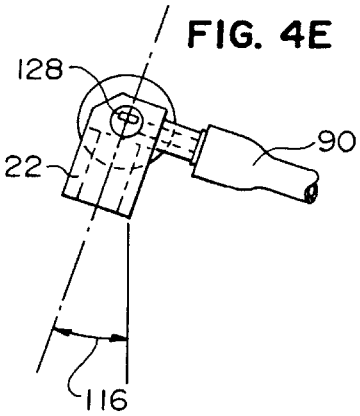
Figure 4F:
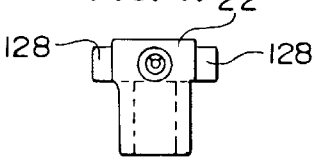
FIG. 4F is a front elevational view of the pivotal actuator shown in FIG. 3A.

As best seen in FIGS. 4C and 4D, each of the tabs 128 are slightly oblong in cross-sectional shape and have a first diameter 130 parallel to the length of the channels 122. The first diameter 130 is greater in length than a second transverse diameter 132 which is perpendicular to the first diameter 130. When the nozzle 22 is in a position so that the first diameter 130 of the tab 128 is parallel to the length of the channels 122, the nozzle is vertically and reciprocally displaceable using hand pressure. This is due to the dimension of the second diameter 132 relative to the width of the channels 122. The nozzle 22 may be vertically displaced relative to the channels 122 when the nozzle is between a fully unrotated position (zero degrees, as illustrated in FIG. 4C) and an outwardly rotated position of less than about twenty degrees, as illustrated in FIG. 4E. The angle of rotation is a function of the width of channels 122, the dimension of tabs 128, and the material from which tabs are constructed. Thus, rotation of the nozzle 22 by less than about twenty degrees in the illustrated embodiment is not sufficient to cause the first diameter 130 of the tabs 128 to operatively engage the channel sidewalls 124 in a frictional manner.

When the nozzle 22 is rotated or pivoted forward, as shown by arrow 116 in FIG. 4E such as by rotating the bottle 34 outwardly from the housing 12, the bottle 34 which is attached to the nozzle may be rapidly and conveniently removed and replaced. Rotation of the nozzle 22 causes the first or longer diameter 130 of the tabs 128 to frictionally engage the sidewalls 124 of the channels 122 causing the nozzle 22 to be vertically locked in position relative to the channels. Thus, rotation of the nozzle 22 by about twenty degrees is sufficient to frictionally maintain the nozzle in the outwardly rotated position to facilitate engagement and disengagement of the bottle 34 from the nozzle at an angle relative to the housing 12. Preferably, rotation of the nozzle between about twenty and thirty degrees in the illustrated embodiment facilitates frictional locking engagement. The tabs 128 are formed from material, such as plastic, which may slightly deform under pressure. Thus, the tabs 128 slightly deform within the channel sidewalls 124 creating friction sufficient to maintain the nozzle 22 in the outwardly rotated position. This facilitates rapid and convenient reciprocal engagement and disengagement of the bottle 34 from the nozzle 22. The bottle 34 is preferably held by the nozzle by means of a pressure fit, as is well known in the art. Alternately, the tabs 128 may be formed from hard material while the channel 122 and guide portions 120 are formed from softer, slightly deformable material to achieve the same result.

As best shown in FIG. 3, the switch array 86, such as a dual in-line package switch, is mounted to a printed circuit board 150 which is secured to ribs (not shown) molded into the housing 12. The switch array 86 allows the user to selectively modify the operation of the apparatus 10, as will be described in greater detail hereinafter. A visual indication of the status of the apparatus 10 is provided by two light-emitting diodes (LED1 151 and LED2 152) which are visible through the viewing window 18. Alternatively, LCD displays, or any other suitable visual display device may be used.

The apparatus 10 includes a speed reduction transmission system 172 mounted to the motor plate 31. The transmission system 172 includes a main pinion gear 174 driven by a drive motor 176 operationally coupled to the main pinion gear. The pinion gear 174 couples to a drive gear 178 having a secondary pinion gear 180 which in turn couples to an intermediate gear 182. The intermediate gear 182 has an actuator drive gear 184 which engages an actuating member 186, such as a segment gear or the like. The actuating member 186 has a cam or hammer 188 for contacting the top of the nozzle 22 to depress the nozzle. A spring 190 disposed under the nozzle 22 or within the bottle 34 causes the actuator nozzle 22 to rise after being depressed to facilitate the pumping action. However, it will be recognized that any suitable pump actuating mechanism may be employed to pump fluid from the bottle 34 and into nozzle 22.

The housing 12 includes a pair of integrally formed holding cavities 192 and 194 for housing a pair of 1.5 volt D-cell batteries 196 (FIG. 3) which supply power to various portions of the apparatus 10.

Figure 5:
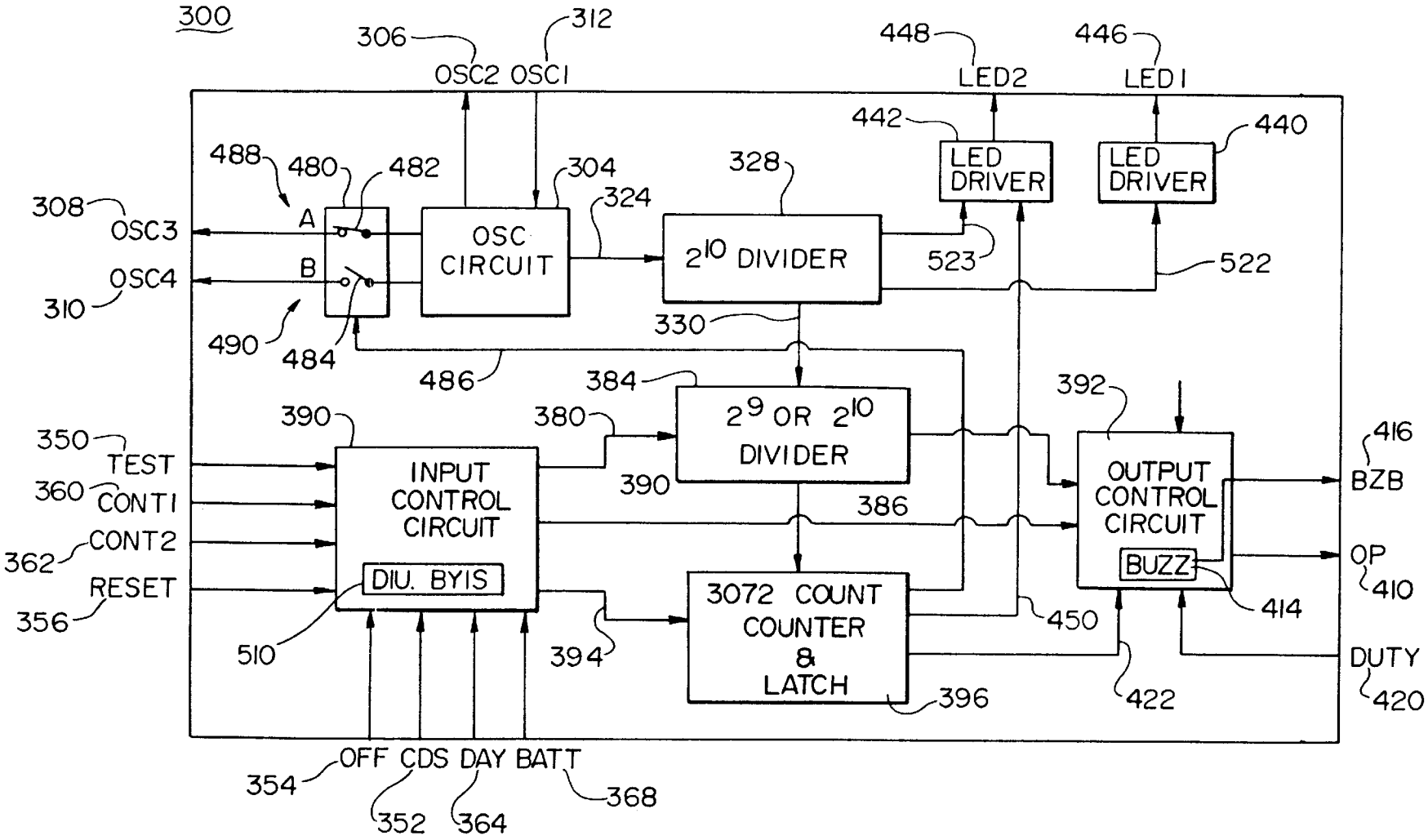
FIG. 5 is a block diagram of an integrated circuit for use as part of a control circuit according to the present invention.
Figure 6:
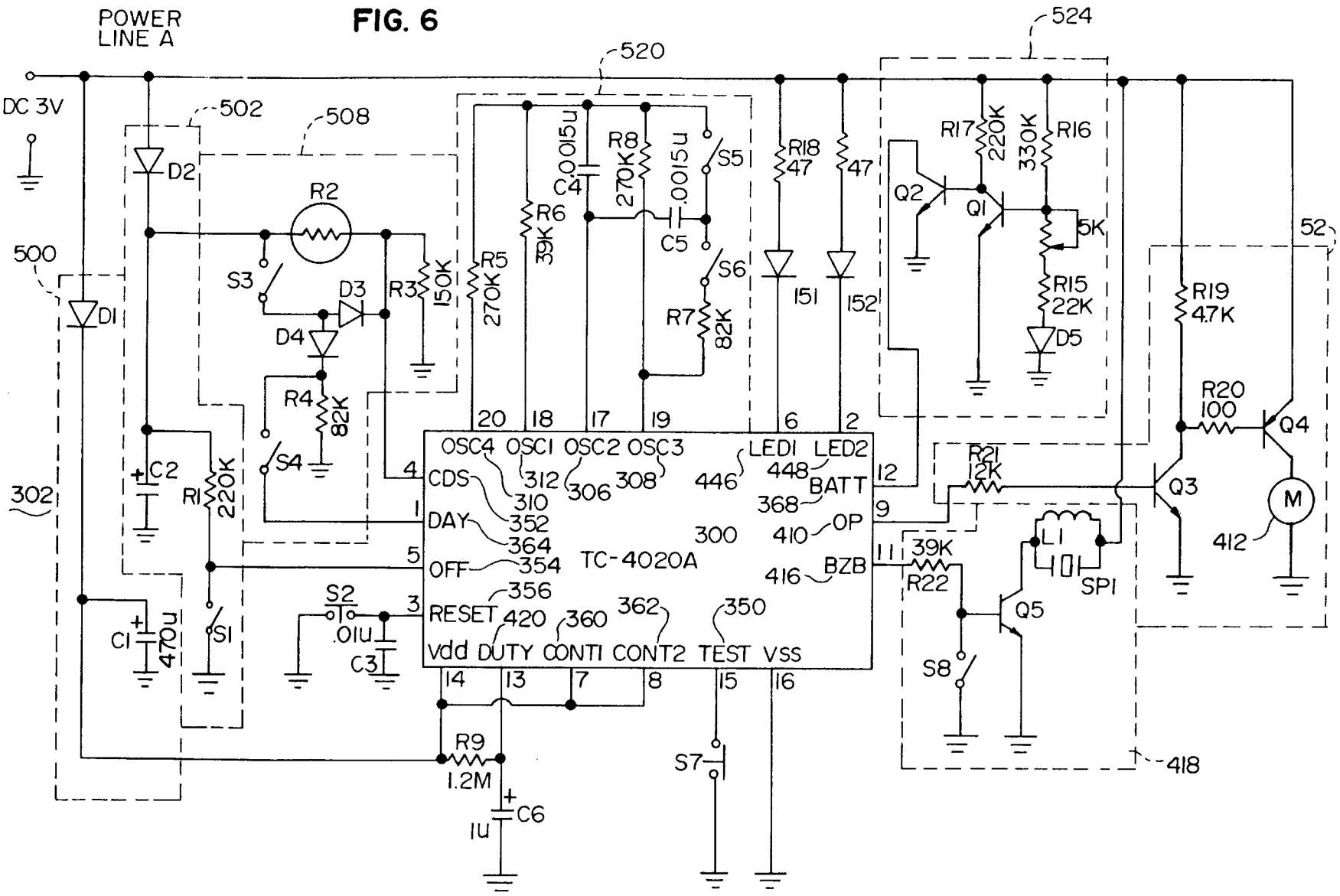
FIG. 6 is a circuit diagram of a specific embodiment of the control circuitry for a chemical delivery apparatus having a pivotal actuator nozzle.

Referring now to FIGS. 3, 5, and 6, FIG. 5 is a block diagram generally depicting an integrated circuit (IC) 300 and FIG. 6 is a schematic diagram implementing the integrated circuit shown in FIG. 5. The integrated circuit 300 is used as part of a control circuit 302 for operating the dispensing apparatus 10. The IC 300 is preferably a model TC-2020 chip manufactured by Holtek Microelectronics Inc., Taiwan. However, any suitably programmed microcomputer or other discrete circuitry may also be used.

The IC 300 includes an oscillator circuit 304 for providing oscillator output signals OSC2 306, OSC3 308 and OSC4 310, and for receiving a variable oscillator input signal OSC1 312. The oscillator circuit 304 provides a frequency output signal 324 to a divider "A" circuit 328 which divides the frequency output signal by a value of 1024 to produce a divider "A" first output signal 330. The number of pulses or the frequency of the output signal 324 varies in accordance with resistance and capacitance changes that are selectable by the user through a selectable switching arrangement in conjunction with the signals OSC1 312, OSC2 306, OSC3 308 and OSC4 310, as will be described hereinafter.

An input control circuit 340 receives various inputs, such as TEST 350, CDS 352, OFF 354, RESET 356, CONT1 360, CONT2 362 DAY/NIGHT 364 and BATT 368. The input control circuit 340 generates an input control first output signal 380 which controls a divider "B" circuit 384. The divider "B" circuit 384 receives its frequency input from the divider "A" first output signal 330 and divides that frequency by a value of 1024. The divider "B" circuit 384 then produces a divider "B" output signal 386 under control of the input control circuit 340. The divider "B" circuit 384 can either divide the input by a value of 512 or by a value of 1024, depending upon the state of the CONT2 pin 362. Preferably, the CONT2 pin is set high so that the divider "B" circuit divides by a value of 1024.

The input control circuit 340 also provides an input control second output signal 390 which is received by an output control circuit 392. Additionally, the input control circuit 340 generates an input control third output signal 394 which is received by a counter & latch circuit 396.

The output control circuit 392 provides an output pulse signal OP 410 to activate a drive motor 412 to periodically depress the nozzle 22. For example, during normal operation, a pulse interval of a predetermined number of counts that correspond to approximately 15 minutes is set so that an output pulse OP 410 occurs every 15 minutes to eject liquid 38 from the bottle 34.

The output control circuit 392 also includes a multi-tone audible signal generating circuit 414 that generates an output buzzer pulse BZB 416 to activate an external buzzer circuit 418. The output control circuit 392 receives a DUTY signal 420 determined by a resistor/capacitor combination R8 and C6, shown in FIG. 6. If the DUTY signal 420 is connected to ground, then the OP signal 410 provides a ⅓ duty cycle pulse stream having a pulse width of about one second. The R/C combination is chosen so that the drive motor 412 is activated for a period of time sufficient to depress the nozzle 22. The output control circuit 392 also receives a counter & latch signal 422 from the counter & latch circuit 396 that indicates when a predetermined time-out period has occurred, such as when a total of 3,072 pulses have been output (e.g. the bottle 34 is empty) so that the drive motor 412 may be inhibited and the user notified to replace the bottle.

The divider "A" 328 divides the frequency output signal 324 from the oscillator circuit 304 into a visual flash pulse signal to drive a first LED drive circuit 440 and a second LED drive circuit 442. The first and second LED drive circuits 440 and 442 activate and deactivate a first LED 446 and a second LED 448, respectively. A maximum pulse count signal 450 is latched by the counter & latch circuit 396 at a maximum counter value corresponding to when a refill of the bottle 34 is required, such as when the count equals 3072. This corresponds to a bottle empty condition. The maximum pulse count signal 450 is coupled to the second LED driver circuit 442 and directs the second LED driver circuit 442 to activate the second LED 448 to provide a visual indication corresponding to the bottle empty condition.

The first LED driver circuit 440 drives the first LED 446 when a low battery condition is detected. Both the first LED driver circuit 440 and the second LED driver circuit 442 include a one-shot circuit (not shown) which provides a 1/128 duty cycle to the corresponding LED's 446 and 448 so that power is conserved.

The oscillator circuit 304 includes a bilateral switch block 480 which contains a switch "A" 482 and a switch "B" 484. Switch "A" and switch "B" 482, 484 are controlled by a switch control signal 486 generated by the counter & latch circuit 346 that allows the oscillator circuit 304 to operate in one of two predetermined modes. When the oscillator circuit 304 is operating in an "A" mode, an oscillator "A" 488 is operational. The oscillator "A" 488 includes the input signal OSC1 312 and the output signals OSC2 306 and OSC3 308, while an oscillator "B" 490 includes the input signal OSC1 and the output signals OSC2 306 and OSC4 310. When the counter & latch circuit 396 is incremented to its maximum pulse count of 3072, the switch control signal 486 is issued to instruct the bilateral switch block 480 to switch to an oscillator "B" mode. The generation of particular frequencies for the oscillator circuit 304 will be described in greater detail hereinafter with respect to the circuit diagram of FIG. 6.

Referring to FIGS. 3, 5, and 6, the IC 300 with support circuitry necessary to complete the control circuit 302 for operation of the dispensing apparatus 10 is shown in FIG. 6. The control circuit 302 includes a memory backup circuit 500 formed by a diode D1 and a capacitor C1 to provide a suitable voltage level to the IC 300 when power is removed. A power supply circuit 502 includes an "ON/OFF" switch S1 coupled to a current limiting resistor R1. The current limiting resistor R1 couples to a filtering capacitor C2 and a diode D2. A three volt DC source of power, such as the batteries 196, supply three volts to the diode D2 and is labeled Power Line A.

A reset circuit 504 formed by a "RESET" momentary switch S2 and a capacitor C3 allows the IC 300 to be manually reset upon the depression of the RESET switch S2. For example, when the bottle 34 is empty, a new bottle is inserted into the apparatus 10 and the user then resets the control circuitry 302 to again begin the timing and control process.

A light sensing circuit 508 includes a photo-sensitive element, such as a photo resistor R2, which has a resistance that varies with the amount of light sensed by the resistor R2. An "AUTO/24 HR" switch S3 allows selection between continuous operation (24 hour continuous operation) and automatic operation (operation dependent on lighting conditions). When the AUTO/24 HR switch S3 is closed, the power line A connects to the CDS pin 352 in the IC 300 through a diode D3 thereby bypassing the photo resistor R2. This indicates to the input control circuit 340 that a continuous twenty-four hour operation has been selected. The diode D3 is coupled to a diode D4 and a current limiting resistor R4 that, in turn, is coupled to ground. The resistors R3 and R4 serve as current limiting resistors. When operating in the automatic mode (switch S3 is open), a variable voltage level on the CDS pin 352 indicates the amount of light detected, and the output pin OP 410 is controlled in response thereto.

A "DAY/NIGHT" switch S4 allows the user to select between a day and a night mode of operation. The DAY/NIGHT switch S4 in combination with the AUTO/24 HR switch S3 provides a selectable daytime mode or nighttime mode. To select the daytime mode, the AUTO/24 HR switch S3 is opened, indicating the automatic mode. Once in automatic mode, the apparatus 10 is responsive to the amount of light detected, as indicated by the voltage level present on the CDS pin 352.

An internal counter 510 in the input control circuit 340, such as a divide by fifteen counter, calculates a preset time period during which, if an insufficient amount of light is sensed, a night condition is indicated. When the DAY/

NIGHT switch S4 and the AUTO/24 HR switch S3 are both open, a high voltage level is produced on the DAY pin 364 and if the CDS pin 352 is set to a low voltage (insufficient amount of light), the internal counter 510 starts to count. If there is insufficient light for a night threshold period of approximately 15 times the pulse interval of fifteen minutes, the input control circuit 340 assumes that a night condition exists. When the level of light has increased sufficiently, the CDS pin 352 becomes high due to voltage level produced by the photo resistor R2. This indicates that morning has arrived (e.g., enough light for a sufficient period of time).

When this occurs, the output control circuit 392 issues four pulses on the signal OP 410 to command the drive motor 412 to eject four pulses of liquid from the bottle 34. This feature is designed to increase the fragrance level in the morning after no liquid was dispensed during the night. If the darkness period is less than a night threshold period, the input control circuit 340 assumes that light is sensed periodically, as may occur when the ambient light is turned off for a short period of time. If this occurs, the counter 510 within the input control circuit 340 is reset each time the CDS pin 352 indicates that sufficient light has been sensed.

The control circuit 302 may also output pulses on the OP signal 410 when the control circuit determines that nighttime has arrived. When the DAY/NIGHT switch S4 is closed and the AUTO/24 HR switch S3 is opened, the IC 300 generates four pulses on the OP signal 410 at the beginning of the time when an insufficient amount of light has been sensed for a predetermined period of time. This indicates that nighttime has arrived.

During the 24 hour mode, the AUTO/24 HR switch S3 is closed and the control circuit 302 generates an output pulse OP 410 approximately every fifteen minutes during both morning and night conditions, regardless of lighting conditions. No sequence of four pulses OP 410 is generated during the morning and night transition periods.

A variable frequency selection circuit 520 allows the user to select between a normal mode or a selectable mode where a light and heavy liquid dispensing operation may be selected. The variable frequency selection circuit 520 includes a NORMAL switch S5 and a LIGHT/HEAVY switch S6. When the NORMAL switch S5 is opened, a normal mode is selected and the LIGHT/HEAVY switch S6 has no effect on system operation. When the NORMAL switch S5 is closed, the LIGHT/HEAVY switch S6 controls selection of the mode of the oscillator circuit 304.

In the normal mode (NORMAL switch S5 in the opened position) the amount of capacitance present at the OSC2 pin 306 is essentially governed by a capacitor C4 coupled between the OSC2 pin 306 and the combination of resistors R5 and R6 coupled to the OSC4 pin 310 and the OSC1 pin 312, respectively. The closing of the LIGHT/HEAVY switch S6 has minimal effect and only slightly changes the capacitance present at the OSC2 pin 306. For example, in the normal mode with the NORMAL switch S5 open, the closing of the LIGHT/HEAVY switch S6 may only charge the basic oscillating frequency of the oscillator circuit 304 by less than 0.7% of its nominal frequency of 1.2 KHz.

When the NORMAL switch S5 is closed, however, a capacitor CS is essentially in parallel with the capacitor C4, thus significantly modifying the capacitance between the OSC4 pin 310 and the OSC2 pin 306. When the NORMAL switch S5 and the LIGHT/HEAVY switch S6 are both closed, a resistor R7 is in parallel with a resistor R8, where the parallel resistor combination is coupled between the OSC3 pin 308 and the capacitor combination of C4 and CS. This modified R/C combination causes the oscillator circuit 304 to operate at an increased frequency, essentially double that of the normal frequency, or 2.4 KHz.

This increased frequency causes the counters and dividers 340, 328 and 384 to operate at an increased frequency and causes the maximum count value to be reached sooner than in the normal mode of operation. Such a condition represents a heavy mode of operation where activation of the nozzle 22 occurs at twice the rate as in the normal mode of operation.

When the NORMAL switch S5 is closed and the LIGHT/HEAVY switch S6 is opened, the resistor R7 is essentially an open circuit and only the resistor R8 is in combination with the capacitors C4 and C5. This modified R/C combination causes the oscillator circuit 304 to operate at one-half of its normal frequency, or 0.6 KHz. This reduced frequency represents a light mode of operation since the nozzle 22 will be operated at one-half of its normal rate and dispense one-half of the normal amount of liquid. This allows the bottle of liquid 38 to last twice as long compared to the normal mode of operation.

The duty cycle pin DUTY 420 is connected to the combination of a capacitor C6 and a resistor R9. The other end of the capacitor C6 is connected to ground while the other end of the resistor R9 is connected to the power line A. The combination of the resistor R9 and the capacitor C6 forms an R/C timing circuit which controls the duty cycle of the integrated circuit.

A test switch S7 coupled to a TEST pin 350 may be depressed to temporarily ground the TEST pin and place the integrated circuit 300 in a test mode. When the TEST pin 350 is connected to ground, the divider "B" circuit 384 and the counter latch circuit 396 are tested for proper functioning.

The CONT2 pin 352 is tied high so that a maximum count of output pulses OP 410 (ejections from the nozzle 22) must equal 3072 before the input control circuit 340 determines that the bottle 34 is empty. High and low voltage levels may be applied to CONT2 pin 352 can vary the maximum count, thus varying the output of pulses on OP 410.

In operation, specifically in the normal mode of operation, the oscillator circuit 304 produces a 1.2 KHz frequency on the frequency output signal 324. The divider "A" circuit then divides the frequency output signal 324 by a value of 1024 to produce approximately a 1.2 Hz. signal (1.1719 Hz, divider "A" first output signal 330). The divider "A" first output signal 330 is also routed to an input 522 of the first LED driver circuit 440 and an input 523 of the second LED driver circuit.

The divider "B" circuit 384 divides the frequency output signal 324 by a value of 1024 and produces approximately a 0.001144 Hz signal on the divider "B" output signal 386. This represents a pulse which occurs approximately every 873.8 seconds or approximately every 15 minutes (14.56 minutes). The counter latch circuit 396 counts 3072 such pulses occurring approximately every 15 minutes to produce the maximum pulse count signal 450. This occurs approximately once every 31 days and indicates that the bottle is empty.

A battery voltage detection circuit 524 determines when the battery voltage drops below a predetermined threshold set by a voltage divider that includes resistors R15, R16 and a variable resistor R17. The variable resistor R17 may be adjusted to vary the low battery threshold level. The variable voltage level set by the variable resistor R17 drives the base of an NPN transistor Q1. The emitter of the transistor Q1 is grounded while the collector is coupled to the power line A through the current limiting resistor R17. The collector of the transistor Q1 also drives the base of a transistor Q2. The emitter of the transistor Q2 is coupled to ground while its collector provides the threshold indicator to the BATT pin 308 of the IC 300.

When the battery voltage is above the minimum threshold, for example, above 2.7 volts, the transistor Q1 is turned on and the transistor Q2 is turned off, indicating to the IC 300 that the battery has remaining useful life. Accordingly, the first LED 151 is not illuminated.

The collector of the transistor Q2 is internally pulled to a high voltage level within the IC 300. When the battery voltage falls below the minimum threshold value, the transistor Q1 turns off which allows the collector of the transistor Q1 to be pulled high through the resistor R17. This turns on transistor Q2 causing its collector to be coupled to ground, thus providing a low signal to the BATT pin 368. The IC 300 interprets this as a low battery condition and illuminates the first LED 151.

The first LED 151 is coupled between the LED1 pin 446 and a current limiting resistor R18. The first LED 151 indicates the state of the battery and depends upon the condition of the BATT pin 368. The IC 300 energizes the first LED 151 at a predetermined duty cycle when a low battery condition is detected. The first LED 151 will flash at a periodic rate driven by the first LED drive circuit 440. The flashing rate or duty cycle of the first LED 151 is 1/128. This is selected to conserve power while informing the user of a low battery condition.

However, the visual indicating mode of the first and second LEDs 151 and 152 may be reversed by simple reconfiguration of the CONT1 pin 360. If the CONT1 pin 360 is tied low instead of high, the first LED 151 will not flash when a low power condition is sensed but rather, will flash only when the battery voltage level is sufficient. Alternatively, an AC/DC adapter (not shown) may be incorporated into the apparatus 10 so that the dispensing device may be plugged into an AC wall socket, as is well known in the art.

The second LED 152 is activated when the number of OP pulses 410 reaches the predetermined maximum pulse count to indicate that the bottle 34 is empty and must be changed. The CONT 2 pin 362 controls the second LED 152 to indicate a bottle empty condition. The counter & latch circuit 396 supplies the a maximum pulse count signal 450 to energize the second LED 152. The second LED 152 is similarly coupled between the LED2 pin 448 and the Power Line A through a current limiting resistor R18*a*.

The second LED 152 is energized only after the counter & latch circuit 396 has counted to its maximum count of 3072. This notifies the user to replace the bottle 34. Approximately 745.6 hours are required for the maximum pulse count of 3072 to be reached while operating in the 24 hour mode. Therefore, the bottle 34 need only be changed approximately every 31 days. In the light mode (non-heavy mode) of operation, the time interval between bottle changes may be double, or 62 days. This time period may increase by use of the DAY/NIGHT mode, which only dispenses liquid during certain preselected day or night conditions.

A motor driver circuit 526 includes transistors Q3 and Q4, resistors R19, R20 and current limiting resistor R21. The motor driver circuit 526 provides drive current for the motor 412 which activates the cam 188 to depress the nozzle 22. When the IC 300 provides the OP pin 410 with a pulse, the transistor Q3 turns on, thus driving the base of the transistor Q4 low. This turns on the transistor Q4 to place the drive motor 412 across the power line A and ground thereby activating the motor. Conversely, a low level on the OP pin 410 allows the base of the transistor Q4 to float high, thus turning off the transistor Q4 and isolating the drive motor 412.

The oscillating buzzer circuit 418 generates an audible tone when the output pin BZB 416 is driven high. This occurs when the counter & latch circuit 396 counts to the maximum pulse count of 3072 OP pulses, thereby audibly indicating that the bottle 34 is empty. The BZB pin 416 is coupled to the base of a transistor Q5 through a current limiting resistor R22. When the BZB pin 416 is activated, the transistor Q5 oscillates and amplifies the signal to produce an audible tone through an audio speaker SP1. The audio speaker SP1 and an inductor L1 are connected in parallel between the collector of the transistor Q5 and the power line A. If the CONT1 pin 350 is connected to ground, the audio feature is disabled.

A "TONE/QUIET" switch S8, when closed, connects the base of the transistor Q5 to ground thereby turning-off the transistor Q5 to prevent the audible tone from occurring. Hence, the switch S8 allows the user to select between a quiet mode and an audible tone mode.

The first and second LEDs 151 and 152 and the optical detector R2 communicate with the ambient environment through the view window 18 located in the upper portion of the housing 12, as shown in FIG. 1. Each of the switches S3, S4, S5, S6 and S7 may be a single switch included in a multiple switch dual in-line package (DIP). The switches S1 and S8 may be, for example, toggle switches while the switch S2 may be, for example, a momentary contact switch.

In operation, the control circuit 302, set for a specific depression frequency, activates the drive motor 412 which causes the cam/hammer 188 to depress the nozzle 22. The olfactory liquid 38 is ejected by the subsequent pump action into the conveying tube 90 through the nozzle 22. Preferably, the amount of depression force and the rate at which the nozzle 22 is depressed is adjusted so that a sufficient quantity of the liquid 38 is dispensed.

The control circuit 302 receives power through the ON/OFF switch S1 which connects the 3-volt battery supply (Power Line A) to the control circuit. The apparatus 10 is controlled so that the nozzle 22 will be periodically depressed to dispense approximately 28 ounces of liquid 38 in a 31-day period. The pump (e.g., nozzle 22 and stem 36) may be a 110 milliliter pump or any suitable pump. A predetermined count is selected which corresponds to the number of depressions necessary to dispense the entire amount of liquid during that 31-day period. Once the predetermined count is reached, for example 3072 depressions of the nozzle 22, the second LED 152 is activated.

The LIGHT/HEAVY switch S6 allows the user to vary the depression frequency according to desired fragrance levels. For example, when the NORMAL switch S5 is closed so that the LIGHT/HEAVY switch S6 is effective, the depression frequency may be varied from one depression every 30 minutes in the light operation mode, to one depression every 7½ minutes in the heavy operation mode, depending on the desired odorizing level. Depression of the nozzle 22 occurs about once every 15 minutes in the normal operation mode, where the LIGHT/HEAVY switch S6 has no effect.

When the AUTO/24 HR. switch S3 is set in the auto operation mode, the optical detector R2 will turn off the dispensing apparatus 10 if there is insufficient illumination in the room to activate the optical detector. This allows the conservation of olfactory liquid 38 and battery power during periods in which the urinal or toilet bowl are not being used.

Figure 7:
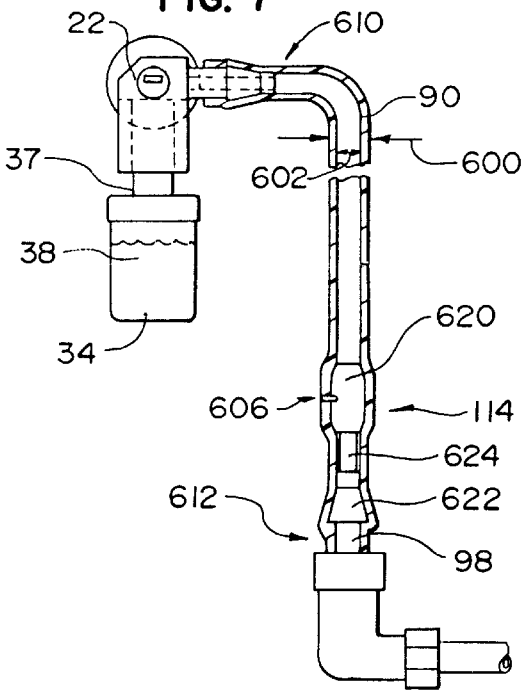
FIG. 7 is a side elevational view of a hose insert according to the present invention shown disposed within the conveying tube.

Referring now to FIGS. 2 and 7, FIG. 7 shows the hose insert or restrictor insert 114 in greater detail where the hose insert is shown secured within the conveying tube 90. The conveying tube 90 has an outside diameter 600 and an inside diameter 602 which may change slightly along its length since the material from which the conveying tube is formed is elastic or deformable in nature. Thus, the conveying tube 90 may deform under the pressure of the liquid 38 ejected into the conveying tube. The conveying tube 90 may, for example, be formed from soft plastic or rubber such as silicone rubber or surgical-type rubber tubing. However, any suitable elastic or rubber material may be used.

The restrictor insert 114 is configured to selectively regulate the volume of liquid 38 ejected into the conveying tube 90 and hence, the liquid back pressure. The conveying tube 90 is defined as having a source end 610 for receiving the liquid 38 from the nozzle 22 and the pump mechanism 37, and a drain end 612 for discharging the liquid into the nipple 98. The ability to regulate the volume of liquid 38 ejected by the nozzle 22 and the ability to regulate and maintain a predetermined level of liquid back pressure is extremely advantageous. Several conditions exist which necessitate use of the restrictor insert 114.

First, as liquid 38 is ejected into the conveying tube 90 and travels downwardly within the tube, a siphon effect is created which tends to create a slight vacuum within the conveying tube. This causes additional liquid 38 to be "sucked" from the bottle 34 through the nozzle 22. This may result in premature emptying of the bottle 34.

Second, the conveying tube 90 eventually terminates at its suitable destination device (not shown) which may, for example, be a urinal, a toilet and the like. Such devices, when activated or flushed, tend to create a vacuum further increasing the vacuum which may already be present within the conveying tube 90. The siphon effect described above is further increased when the destination device is flushed which may also result in premature emptying of the bottle. This effect may be amplified during simultaneous liquid ejection and destination device flushing since the vacuum or siphon effect acts upon an "open" nozzle 22.

Third, when the nozzle 22 is functioning properly, the siphon effect does not present problems. However, the nozzle 22 may not be functioning properly and may become temporarily unseated after liquid 38 has been ejected. Dirt and particulate matter may cause the nozzle 22 to temporarily jam, thus allowing liquid 38 to be drawn out of the bottle 34 between ejections. If the nozzle 22 becomes temporarily jammed (in an open or "leaky" state), the siphon effect can drain a significant portion of the liquid 38 from the bottle 34. The restrictor insert 114 reduces or eliminates the additional volume of liquid discharged due to the above-described act.

Fourth, the nozzle 22 and the pump mechanism 37 perform optimally when a predetermined amount of back pressure is created within the conveying tube 90 during liquid ejection. Such back pressure, in part, is due the elastic nature of the conveying tube 90. The amount of back pressure required depends upon the size of the nozzle orifice (not shown). For reasons of manufacturability, different nozzles 22 may be interchanged, which may have different diameter orifices. To insure optimal nozzle 22 performance, the back pressure must be adjusted for each different nozzle type. The restrictor insert 114 provides a method for adjusting and maintaining the required amount of back pressure within the conveying tube 90.

Referring now to FIGS. 7, 8*a*–8*c* and 9*a*–9*c*, the restrictor insert 114 shown generally. The restrictor insert 114 includes a head portion 620, a tail portion 622 and a central portion 624 connected between the head portion and the tail portion. The head portion 620, the tail portion 622 and the central portion 624 are preferably integrally formed using injection molding or other suitable heat processing techniques.

The restrictor insert 114 is disposed within the conveying tube 90 between the source end 610 and the drain end 612 of the conveying tube to selectively regulate the volume of liquid 38 ejected into the conveying tube. The restrictor insert 114 is coaxially disposed within the conveying tube 90 such that the head portion 620 is disposed toward the source end 610 and the tail portion 622 is disposed toward the drain end 612 of the conveying tube.

The head portion 620 has an outside diameter 630 slightly greater than the inside diameter 602 of the conveying tube 90 to form an interference fit with the conveying tube. Since the conveying tube 90 is formed from relatively elastic material, the conveying tube essentially "stretches" or deforms around the head portion 620. Such deformation, in part, tends to retain the restrictor insert 114 vertically in place.

However, the degree of deformation of the conveying tube 90 is not so great as to create a liquid-tight seal between the head portion 620 and the conveying tube 90. The fluid 38 ejected into the conveying tube 90 creates a sufficient amount of pressure to temporarily deform the conveying tube which is in proximity with the head portion 620, thus allowing the liquid to pass along the surface of the head portion 620 and down through the conveying tube. Such resistance to the passage of the fluid 38 around the head portion 620 essentially prevents inadvertent discharge of fluid 38 due to the siphon effect of fluid flowing within the conveying tube 90 below the vertical level of the restrictor insert 114. Additionally, should the nozzle 22 become temporarily "mis-seated" during liquid ejection, such resistance to fluid flow prevents undesirable discharge of liquid into the conveying tube 90.

The head portion 620 also provides a "self-cleaning" feature. Particulate matter and dirt may accumulate or may be dispensed into the conveying tube 90 during liquid ejection, which could clog typical devices. However, such particulate matter tends to become trapped between the outside surface of the head portion 620 and the conveying tube 90 where the elastic nature of the conveying tube traps the particles in place. The liquid 38 is able to flow around any trapped particulate matter.

The above-described pressure created within the conveying tube 90 between the nozzle 22 and the restrictor insert 114 is referred to as "back pressure" and is required for optimal nozzle 22 performance. The amount of back pressure is adjustable through selective vertical placement of the restrictor insert 114 within the conveying tube 90. The amount of back pressure is inversely proportional to the total amount of deformation of the conveying tube 90 and is dependent upon the diameter and the length of the conveying tube subject to deformation.

If the restrictor insert 114 is placed relatively far from the nozzle 22, a large portion of the length of the conveying tube 90 is subject to deformation and hence, the amount of back pressure is small. If the restrictor insert 114 is placed relatively close to the nozzle 22, a small portion of the length of the conveying tube 90 is subject to deformation and hence, the amount of back pressure is great. By selecting the appropriate vertical position within the conveying tube 90 to fixedly place the restrictor insert 114, the back pressure to which the nozzle 22 is subject can be selectively regulated and maintained.

The ability to selectively regulate the amount of back pressure by appropriate vertical placement of the restrictor insert 114 may, for example, modify the volume of liquid pumped over time by about between 5% to 20%. Thus, in a selected period of time, the amount of liquid ejected can be modified by up to 20%. Similarly, increasing the diameter of the conveying tube 90 and the restrictor insert 114 decreases the amount of back pressure while reducing the diameter of the conveying tube and the restrictor insert increases the amount of back pressure. Additionally, the amount of back pressure may be adjusted by changing the degree of elasticity of the conveying tube 90 by appropriate selection of material. Increasing the elasticity of the conveying tube 90 decreases the back pressure while decreasing the elasticity increases the back pressure.

The central portion 624 has a diameter 634 smaller than the diameter 630 of the head portion 620 and permits the fluid 38 to flow along the central portion without resistance. The head portion 620 is integrally formed with the central portion 624 from a suitable plastic material. The tail portion 622 is also integrally formed with the central portion 624 and may, for example, have a diameter 636 greater than the diameter 634 of the central portion. However, this does not present resistance to fluid flow, as will be described hereinafter.

The tail portion 622 includes an annular flange 638 disposed about its circumference forming a barb which creates an interference fit with the conveying tube 90. This fixedly secures the restrictor insert 114 at a selected vertical position within the conveying tube 90. The annular flange 638 or barb has an increased diameter over the diameter 636 of the tail portion 622 such that the conveying tube 90 essentially "stretches" or deforms around the tail portion and the barb 638.

However, to allow the unimpeded flow of liquid from the head portion 620, along the central portion 624 and through the tail portion 622, a longitudinal channel 644 is disposed along a portion of the tail portion and may also be disposed along a portion of the central portion. The channel 644 also passes through the annular flange 638 so that the flange does not inhibit fluid flow.

Figure 8A:
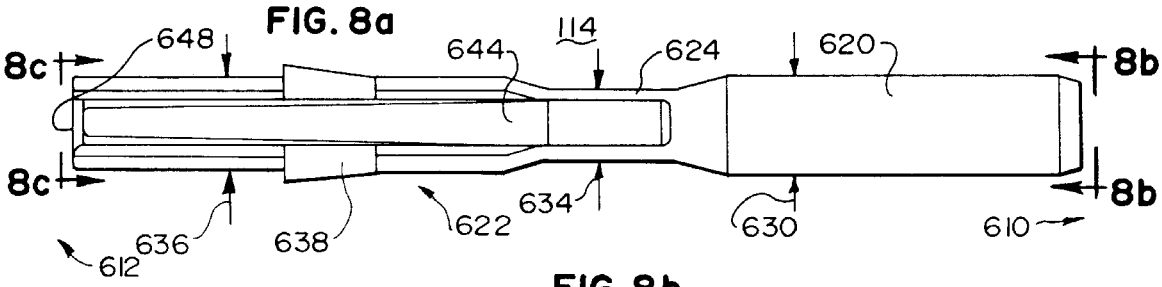
FIGS. 8*a* and 9*a* are side elevational views of the hose insert shown in FIG. 7.
Figure 8B:
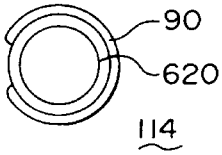
FIGS. 8*b*–8*c* and 9*b*–9*c* are end views of the hose insert shown in FIGS. 8*a* and 9*a*, respectively.
Figure 8C:
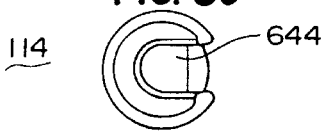
Figure 9A:
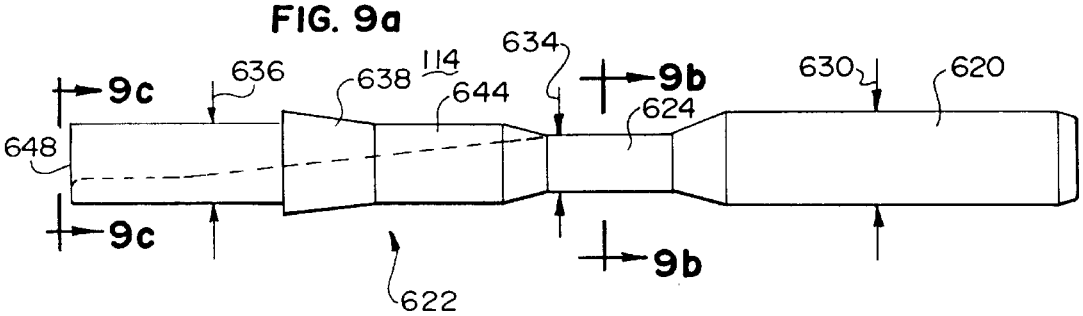
Figure 9B:
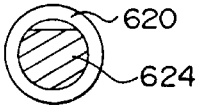
Figure 9C:
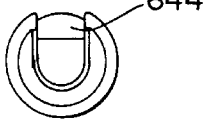

The channel 644 may extend to a distal end 648 of the tail portion 622 so that the distal end does not terminate in a flat cross-sectional area, as illustrated in FIGS. 8*c* and 9*c*. Accordingly, if the restrictor insert 114 is fixedly placed within the conveying tube 90 far from the nozzle 22 and abutting the nipple 98, the distal end 648 cannot block liquid flow into the nipple since the channel permits unimpeded liquid flow.

A specific embodiment of a chemical delivery apparatus having a pivotal actuator according to the present invention has been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. An actuator system for a fluid dispensing apparatus, the fluid dispensing apparatus including a fluid-containing vessel and a housing, the system comprising:

an actuator nozzle having a receiving aperture and a dispensing aperture, the receiving aperture operatively coupled to the vessel to receive the fluid contained in the vessel;

the dispensing aperture in operative communication with the receiving aperture;

the dispensing aperture connected to a conveying tube to direct the fluid from the vessel, through the conveying tube and into a fluid receiving receptacle;

ejecting means operatively coupled to the actuator nozzle to eject the fluid from the vessel into the actuator nozzle and into the conveying tube;

the actuator nozzle being slidingly and pivotally mounted in the housing and configured to slide vertically relative to the housing and to pivot outwardly relative to the housing to permit reciprocal engagement and disengagement of the vessel from the actuating nozzle while maintaining communication between the actuating nozzle and the conveying tube; and the actuator nozzle remaining in an upward and outwardly pivoted position when the actuator nozzle is pivoted outwardly and the vessel is disengaged from the actuator nozzle to facilitate reengagement of a replacement vessel with the actuator nozzle.

2. The actuator system of claim 1 wherein the actuator nozzle includes two tabs outwardly projecting from opposite sides of the actuator nozzle configured to communicate with corresponding guides disposed in the housing, each guide having a channel defined by two sidewalls, said channel slidingly communicating with the tabs to allow reciprocal vertical displacement of the actuator nozzle relative to the housing.

3. The actuator system of claim 2 wherein the tabs are oblong in cross-sectional shape and have a first diameter parallel to the channels that is greater in length than a second diameter perpendicular to the first diameter.

4. The actuator system of claim 3 wherein each tab is in selectable frictional communication with the sidewalls of each channel such that outward pivoting of the nozzle causes the tab to frictionally engage the sidewalls of the channel along its first radius, thus causing the actuator nozzle to be locked vertically relative to the channels while being maintained in the outwardly pivoted position to facilitate reciprocal engagement and disengagement of the vessel from the actuator nozzle.

5. The actuator system of claim 3 wherein the channel sidewalls engage each tab along the second diameter permitting vertical displacement of the actuator nozzle relative to the channels when the actuator nozzle is outwardly rotated less than about twenty degrees from the housing.

6. The actuator system of claim 3 wherein the channel sidewalls engage the tab along its first diameter locking the actuator nozzle in position relative to the channels to prevent vertical displacement of the actuator nozzle when the actuator nozzle is outwardly rotated between about twenty and thirty degrees from the housing.

7. The actuator system of claim 1 wherein the vessel contains a liquid chemical.

8. The actuator system of claim 1 wherein the means for ejecting the liquid from the vessel includes a powered hammer mechanism that engages and downwardly displaces the actuator nozzle relative to the vessel.

9. The actuator system of claim 8 wherein the powered hammer mechanism reciprocally displaces the actuator nozzle to facilitate a pumping effect to eject the fluid from the vessel through the actuator nozzle and into the conveying tube.

10. A liquid dispensing device for controllably dispensing fluids from a fluid-containing vessel, the device comprising:

a housing configured to retain the vessel;

an actuator nozzle mounted within the housing, the actuator nozzle having a receiving aperture and a dispensing aperture in operative communication with the receiving aperture;

the receiving aperture operatively coupled to the vessel to receive the fluid contained therein;

the dispensing aperture coupled to the receiving aperture and connected to a conveying tube to direct the fluid from the vessel, through the conveying tube and into a fluid receiving receptacle;

means for ejecting the fluid from the vessel into the actuator nozzle;

the actuator nozzle being slidingly and pivotally mounted in the housing and configured to slide vertically relative to the housing and configured to pivot outwardly to permit reciprocal engagement and disengagement of the vessel while maintaining communication with the conveying tube;

the actuator nozzle remaining in an upward and outwardly pivoted position when the vessel is disengaged from the actuator nozzle to facilitate reengagement of a replacement vessel with the actuator nozzle.

11. The device of claim 10 wherein the actuator nozzle includes two tabs outwardly projecting from opposite sides of the actuator nozzle configured to communicate with corresponding guides disposed in the housing, each guide having a channel defined by two sidewalls, said channel slidingly communicating with the tabs to allow reciprocal vertical displacement of the actuator nozzle relative to the housing.

12. The device of claim 11 wherein the tabs are oblong in cross-sectional shape and have a first diameter parallel to the channels that is greater in length than a second diameter perpendicular to the first diameter.

13. The device of claim 12 wherein each tab is in selectable frictional communication with the sidewalls of each channel such that outward pivoting of the actuator nozzle causes the tab to frictionally engage the sidewalls of the channel along its first diameter, thus causing the nozzle to be locked vertically relative to the channels while being maintained in the outwardly pivoted position to facilitate reciprocal engagement and disengagement of the vessel from the actuator nozzle.

14. The system of claim 12 wherein the channel sidewalls engage the tab along its second diameter permitting vertical displacement of the actuator nozzle relative to the channels when the actuator nozzle is outwardly rotated less than about twenty degrees from the housing.

15. The device of claim 12 wherein the channel sidewalls engage the tab along its first diameter locking the actuator nozzle in position relative to the channels to prevent vertical displacement of the actuator nozzle when the actuator nozzle is outwardly rotated between about twenty and thirty degrees from the housing.

16. The device of claim 10 wherein the vessel contains a liquid chemical.

17. The device of claim 10 wherein the means for ejecting the chemical from the vessel includes a powered hammer mechanism that selectively engages and downwardly displaces the actuator nozzle relative to the vessel.

18. The device of claim 17 wherein the powered hammer mechanism reciprocally displaces the actuator nozzle to facilitate a pumping effect to eject the fluid from the vessel through the actuator nozzle and into the conveying tube.

19. The device of claim 10 further including a controller for causing periodic ejections of fluid from the vessel.

20. The device of claim 19 wherein the controller generates an audio or visual indication in response to determining that a predetermined amount of fluid has been dispensed from the vessel.

21. The device of claim 20 wherein the indication generated indicates that the vessel contains substantially no fluid.

22. The device of claim 19 further including at least one battery for providing electrical power to the controller.

23. The device of claim 22 wherein the controller further includes a low-battery detection circuit to determine when a low-battery condition exists and to generate an audio or visual indication when the low-battery condition is detected.

24. The device of claim 19 wherein the controller counts the number of times that the controller causes said periodic ejections of fluid from the vessel and generates an audio or visual indication when the count is equal to a predetermined value.

25. The device of claim 19 further including a light sensitive element operatively coupled to the controller to provide the controller with an indication of whether a daylight condition or a night condition exists.

26. The device of claim 25 wherein the controller causes ejection of liquid from the vessel at a first periodic rate when the daylight condition is indicated and causes ejection of liquid from the vessel at a second periodic rate when a night condition is indicated, said first rate being greater than said second rate.

27. The device of claim 26 wherein the controller causes multiple ejections of liquid from the vessel at a third periodic rate for a predetermined period of time when the daylight condition is initially indicated, said third rate being substantially greater than said first and second rates.

28. The device of claim 26 wherein the controller causes multiple ejections of liquid from the vessel at a fourth periodic rate for a predetermined period of time when the night condition is initially indicated, said fourth rate being substantially greater than said first and second rates.

29. A liquid dispensing device for controllably dispensing liquids from a fluid-containing vessel, the device comprising:

a housing configured to retain the vessel;

an actuator nozzle mounted within the housing, the actuator nozzle having a receiving aperture and a dispensing aperture in operative communication with the receiving aperture;

the receiving aperture operatively coupled to the vessel to receive the fluid contained therein;

the dispensing aperture coupled to the receiving aperture and connected to a conveying tube to direct the fluid from the vessel, through the conveying tube and into a fluid receiving receptacle;

pump means operatively coupled to said actuator nozzle for ejecting the fluid from the vessel into the actuator nozzle;

the actuator nozzle and pump means being slidingly mounted in the housing and configured to slide vertically relative to the housing and configured to eject the fluid from the vessel into the conveying tube upon vertical displacement of the actuator nozzle and pump means; and a controller to increment a value of a counter each time the pump means and actuator nozzle is caused to eject fluid from the vessel, said controller to generate a visual or audio indication in response to determining that the value of the counter is equal to a predetermined value where the value of the counter represents that a predetermined amount of fluid has been dispensed from the vessel.

30. The device according to claim 29 wherein the controller generates a pulse causing the pump means and actuator nozzle to eject fluid from the vessel, said pulse causing the value of the counter to be incremented.

31. The device according to claim 1 further including a restrictor insert disposed within the conveying tube, said conveying tube having a source end for receiving the fluid and a drain end for discharging the fluid, said restrictor insert disposed between the source end and the drain end and configured to selectively regulate the volume of fluid ejected into the source end of the conveying tube, said conveying tube formed of a deformable material.

32. The device according to claim 31 wherein the restrictor insert further includes:

a head portion, a tail portion and a central portion connected between the head portion and the tail portion;

said head, tail and central portions configured to be coaxially received within a portion of a length of the conveying tube;

said head portion having an outside diameter greater than an inside diameter of the conveying tube to form an interference fit with the conveying tube, said head portion permitting a predetermined amount of the fluid to pass between its surface and an inside surface of the conveying tube, said passage of fluid effecting temporary expansion of the conveying tube proximal to the head portion;

said central portion having a diameter smaller than the diameter of the head portion to permit the flow of fluid therealong; and said tail portion having a longitudinal channel disposed along a portion of its length to facilitate fluid flow from the head portion, along the central portion, and through the tail portion.

33. The device according to claim 32 wherein the tail portion further includes an annular flange disposed about its circumference forming a barb therearound, said barb forming an interference fit with the conveying tube to secure the restrictor insert at a predetermined vertical position within the conveying tube, said channel passing through the barb to facilitate a flow of fluid therethrough.

34. The device according to claim 32 wherein said interference fit between the head portion and the conveying tube effecting a predetermined increase in pressure within the conveying tube between the head portion and the nozzle, said increase in pressure reducing the flow of liquid ejected from the nozzle by a predetermined amount.

35. The device according to claim 34 wherein said predetermined increase in pressure is fixed at a first predetermined pressure level by decreasing a linear distance between the nozzle and the restrictor insert and is fixed at a second predetermined pressure level by increasing the linear distance between the nozzle and the restrictor insert, said first predetermined pressure level being greater than said second predetermined pressure level.

36. The device according to claim 34 wherein said predetermined increase in pressure is fixed at a first predetermined pressure level by decreasing a diameter of the conveying tube and is fixed at a second predetermined pressure level by increasing the diameter of the conveying tube, said first predetermined pressure level being greater than said second predetermined pressure level.

37. The device according to claim 31 wherein the restrictor insert further includes:

a head portion, a tail portion and a central portion connected between the head portion and the tail portion;

said head, tail and central portions configured to be coaxially received within a portion of a length of the conveying tube;

said head portion having an outside diameter greater than an inside diameter of the conveying tube to form an interference fit with the conveying tube, said head portion permitting a predetermined amount of the fluid to pass between its surface and an inside surface of the conveying tube, said passage of fluid effecting temporary expansion of the conveying tube proximal to the head portion;

said central portion having a diameter smaller than the diameter of the head portion to permit the flow of fluid therealong;

said tail portion having a longitudinal channel disposed along a portion of its length to facilitate fluid flow from the head portion, along the central portion and through the tail portion; and said tail portion having an annular flange disposed about its circumference forming a barb therearound, said barb forming an interference fit with the conveying tube to secure the restrictor insert at a predetermined vertical position within the conveying tube, said channel passing through the barb to facilitate a flow of fluid therethrough.

* * * * *